United States Patent [19]

Garner et al.

[11] Patent Number: 4,964,754

[45] Date of Patent: Oct. 23, 1990

[54] CONCRETE SCREEDING MACHINE

[76] Inventors: James D. Garner, 2704 Boars Head Rd.; John M. Hinnant, 3973 Belair Rd., both of Augusta, Ga. 30907

[21] Appl. No.: 398,254

[22] Filed: Aug. 24, 1989

Related U.S. Application Data

[63] Continuation-in-part of Ser. No. 356,260, May 24, 1989, Pat. No. 4,913,584.

[51] Int. Cl.[5] ..... E01C 19/29

[52] U.S. Cl. ..... 404/123; 404/125

[58] Field of Search ..... 404/103, 106, 116, 119, 404/120, 122, 123, 125

[56] References Cited

U.S. PATENT DOCUMENTS

| | | | |
|---|---|---|---|
| 1,017,430 | 2/1912 | Lilleberg | 404/123 |
| 1,584,385 | 5/1926 | Lichtenberg | 404/119 |
| 2,048,071 | 7/1936 | Jacobson | 404/106 |
| 2,127,485 | 8/1938 | Owens et al. | 404/123 |
| 2,148,214 | 2/1939 | Mall | 404/116 |
| 2,248,103 | 7/1941 | Mall | 404/116 |
| 2,426,702 | 9/1947 | Milliken | 404/119 |
| 2,687,679 | 8/1954 | Clary | 404/123 |
| 3,377,933 | 4/1968 | Dale | 404/98 |
| 4,115,976 | 9/1978 | Rohrer | 52/741 |
| 4,314,773 | 2/1982 | Allen | 404/116 |
| 4,747,726 | 5/1988 | Garner et al. | 404/123 |

*Primary Examiner*—Bruce M. Kisliuk
*Assistant Examiner*—Matthew Smith
*Attorney, Agent, or Firm*—Kennedy & Kennedy

[57] ABSTRACT

A screeding machine has mounted thereon, in order from front to rear, a paving material agitating means for dispersing and expelling trapped air, a screeding roller, and first and second drive rollers. For a fine finish, a finishing roller extends from the rear of the machine.

1 Claim, 3 Drawing Sheets

CONCRETE SCREEDING MACHINE

REFERENCE TO RELATED APPLICATION

This application is a continuation-in-part U.S. patent application Ser. No. 356,260, filed May 24, 1989 now U.S. Pat. No. 4,913,584.

TECHNICAL FIELD

This invention relates to machines for screeding materials such as concrete and cement used in the paving of roads and the like.

BACKGROUND OF THE INVENTION

In efforts to reduce the labor intensive, time consuming screeding of paving materials, numerous types of machines for accomplishing the screeding operation have been developed. Examples of such machines are shown in U.S. Pat. Nos. 1,584,385; 2,426,702; 2,687,679; 3,377,933; 4,115,976; 4,747,726; and in the aforementioned application Ser. No. 356,260 of which this application is a continuation-in-part. In general, these machines comprise a frame supported by two or more rollers, at least one of which is driven, that roll on forms straddling the surface area to be paved and which serve as track or support rails for the machine. A screed roller is located forward on the frame and its axis of rotation is slightly elevated above the axes of the support rollers, so that the screed roller itself is elevated slightly above the support rollers and the forms. The screed roller is generally driven in a reverse direction to that of the support rollers so that as the machine advances through the paving material, which has been dumped between the forms, the screed roller flings and spreads the material ahead of the machine, flattening and leveling the piles thereof into a rough surface. The support rollers then pass over the material, further flattening and smoothing it into a fairly flat, fairly even surface. This surface can be improved by floating or troweling, which is generally done manually by work crews using bull floats or trowels.

In the aforementioned application Ser. No. 356,260, manual troweling or floating is obviated by a finishing roller attachment mounted on the rear of the screeding machine. The finishing roller, which is of smaller diameter than the screeding and support rollers, is rotatably mounted to a pair of support arms, which are pivotally mounted to the machine. Drive means mounted to one of the support arms rotates the finishing roller generally at higher revolutions per minute than the other rollers so that the finishing roller actually slips on the surface of the paving material as the screeding machine is operated. This action causes the soupy material carried in the paving material to rise to the top surface thereof where it is uniformly spread by the finishing roller to produce a highly finished surface. Means are provided for pivoting the support arms so that the finishing roller no longer engages the paving surface, in the event that a highly finished surface is not needed or desired.

While the screeding machines as just described produce an even, smooth, level paved surface, in practice it has been found that when the concrete is poured, air in the form of bubbles and pockets is trapped in the mass. Such air bubbles and pockets tend to reduce the density of the pacing material, weaken the material, and deleteriously effect the finished surface thereof. These effects can be especially damaging where great density and strength of the material is required, such as with airport runways or heavily travelled highways.

Accordingly, it is an object of the invention to provide a screeding machine and method for eliminating, to a large degree, the entrapment of air in poured paving material.

More particularly, it is an object of the present invention to incorporate into the operation of a screeding machine the operation of reducing or eliminating trapped air in the paving material.

SUMMARY OF THE INVENTION

The invention, in a preferred embodiment thereof, comprises an attachment for mounting on the front portion of a screeding machine. The attachment comprises a transversely extending rod swivelly mounted on an array of support posts which are, in turn, mounted on the frame of the machine at the rear thereof. Support arms extend toward the front of the machine and are attached to the swivelably mounted rod. Each support arm has a hanger member depending therefrom which supports a transversely extending beam, on which is mounted an array of hydraulically actuated vibrators, each vibrator having an actuating hydraulic motor mounted adjacent thereto on the beam.

Means are provided for raising and lowering the beam, and hence the vibrators, with the vibrators, in the lowered position, penetrating to a considerable depth the paving material in advance of the screeding roller. When the vibrators are actuated by the individual hydraulic motors, and when in the lowered position, the paving material is agitated to a considerable depth, thereby breaking up and dispersing any existing air bubbles or pockets and allowing the air to escape, with the net result that the paving material is made considerably more dense and air free.

DETAILED DESCRIPTION

Figure 1:
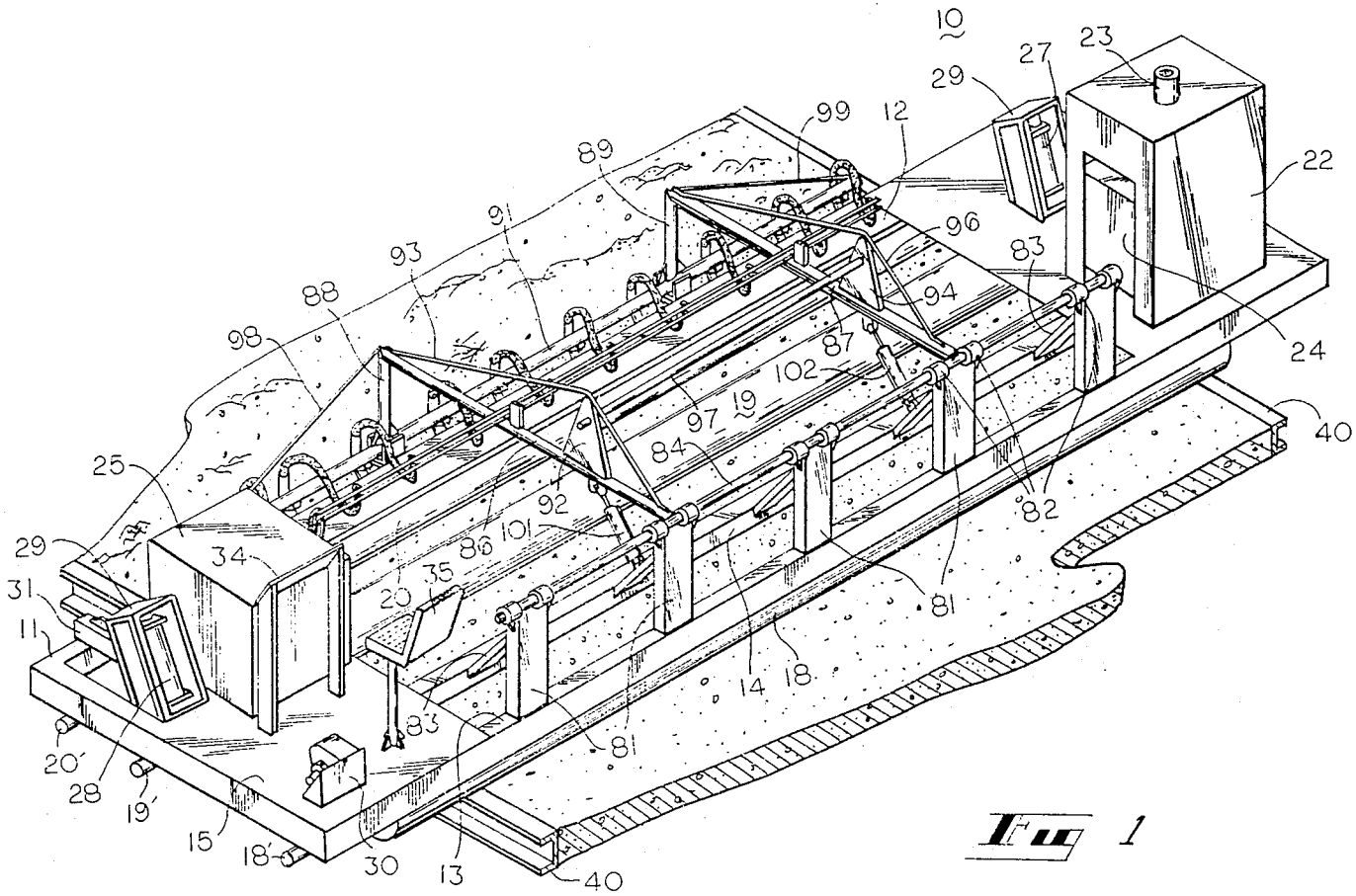
FIG. 1 is a perspective view of a screeding machine which embodies the principles of the present invention and which is shown operating on the paving material of a road being paved, as viewed from a rear quarter.

With reference to FIG. 1, there is depicted a self-propelled screeding machine 10, such as that shown in U.S. Pat. No. 4,747,726, which has a frame that includes a front beam 11 disposed beneath a walkway 12, a rear beam 13 and an intermediate beam 14, all of which span the space between and provide support for two side platforms 15 and 16. Rotatably mounted on the frame and spanning a major portion of the width of the machine are a rear drive roller 18, a forward drive roller 19, and a screed roller 20 located ahead of the forward roller 19.

The machine 10 is provided with a hydraulic power system that includes a diesel engine within a housing 22 from which an exhaust stack 23 extends, and a master pump mounted within a pump housing 24 atop platform 16. The hydraulic system includes an hydraulic fluid reservoir 25 which is mounted on platform 15. The loads powered by the hydraulic power system include a right side hydraulic lift cylinder 27 and a left side hydraulic lift cylinder 28, each of which is mounted in a protective housing 29. The function and operation of such lift cylinders is fully explained in U.S. Pat. No. 4,747,726. Additional system loads include a hydraulic motor 30 mounted on a rear portion of platform 15 for driving the drive roller 18, and a hydraulic motor 31 mounted on a forward portion of platform 15 for driving the screed roller 20. The hydraulic system is of conventional construction and thus its hydraulic lines and controls have not, for clarity, been shown, with one exception which will be discussed hereinafter. It is to be understood that the hydraulic lines extend to and between the several elements of the system, including the loads, with those extending between system components mounted on the two platforms 15 and 16 and passing through the beams 14, which protects them from possible damage during operation. The entire system is controlled from a panel 34 which is positioned behind the reservoir 25 in front of an operator's seat or stool 35.

Figure 3:
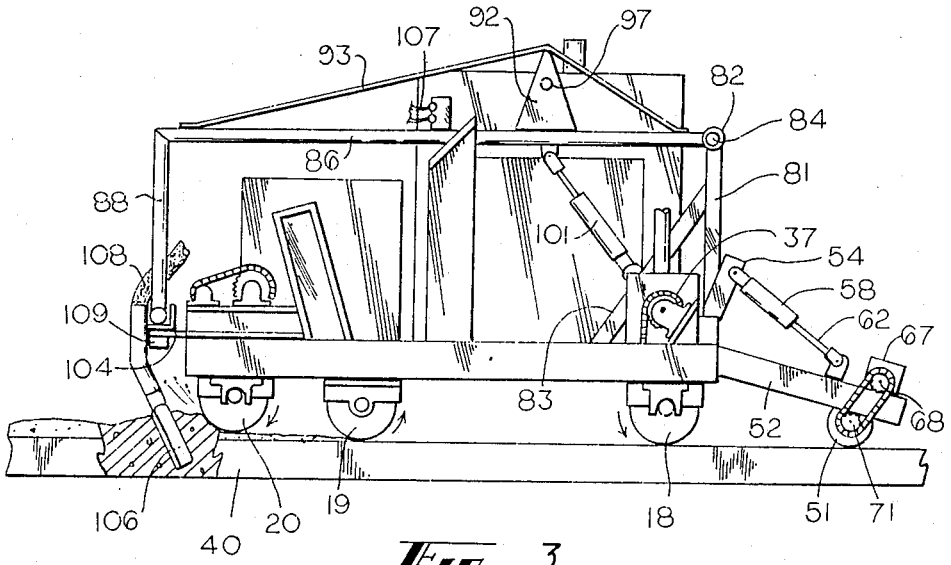
FIG. 3 is a side elevation view of the machine of FIGS. 1 and 2 with the vibrators shown in the lowered position and with the finishing roller added.
Figure 4:
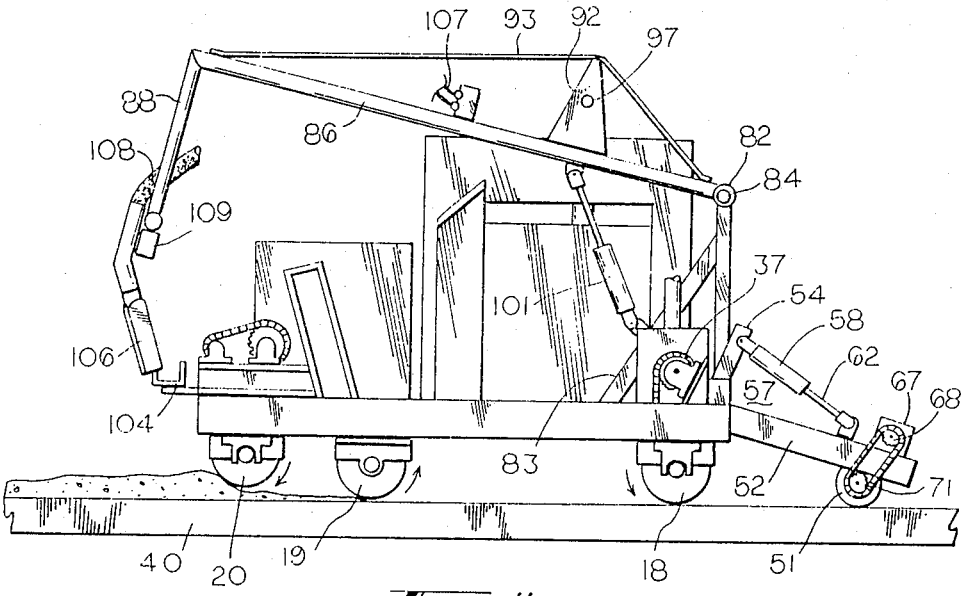
FIG. 4 is a side elevation view of the machine of FIG. 3 with the vibrators in the raised position.

The rear drive roller 18 and the forward drive roller 19 are driven synchronously by power takeoff from hydraulic motor 30. This power takeoff includes a drive chain 37, as best seen in FIGS. 3 and 4, that is routed downwardly from the motor 30 through an opening in the platform 15 and about a sprocket mounted to a portion of the axle 18' that extends outwardly from an end of drive roller 18. The axle 18' is in turn coupled with the axle 19' of drive roller 19 by a chain, not shown, that is routed over sprockets mounted to the two axles. Thus, by operation of the hydraulic motor 30, the drive rollers 18 and 29 can be rotated in the counterclockwise direction indicated by the arrows shown in FIGS. 3 and 4, advancing the machine.

Figure 2:
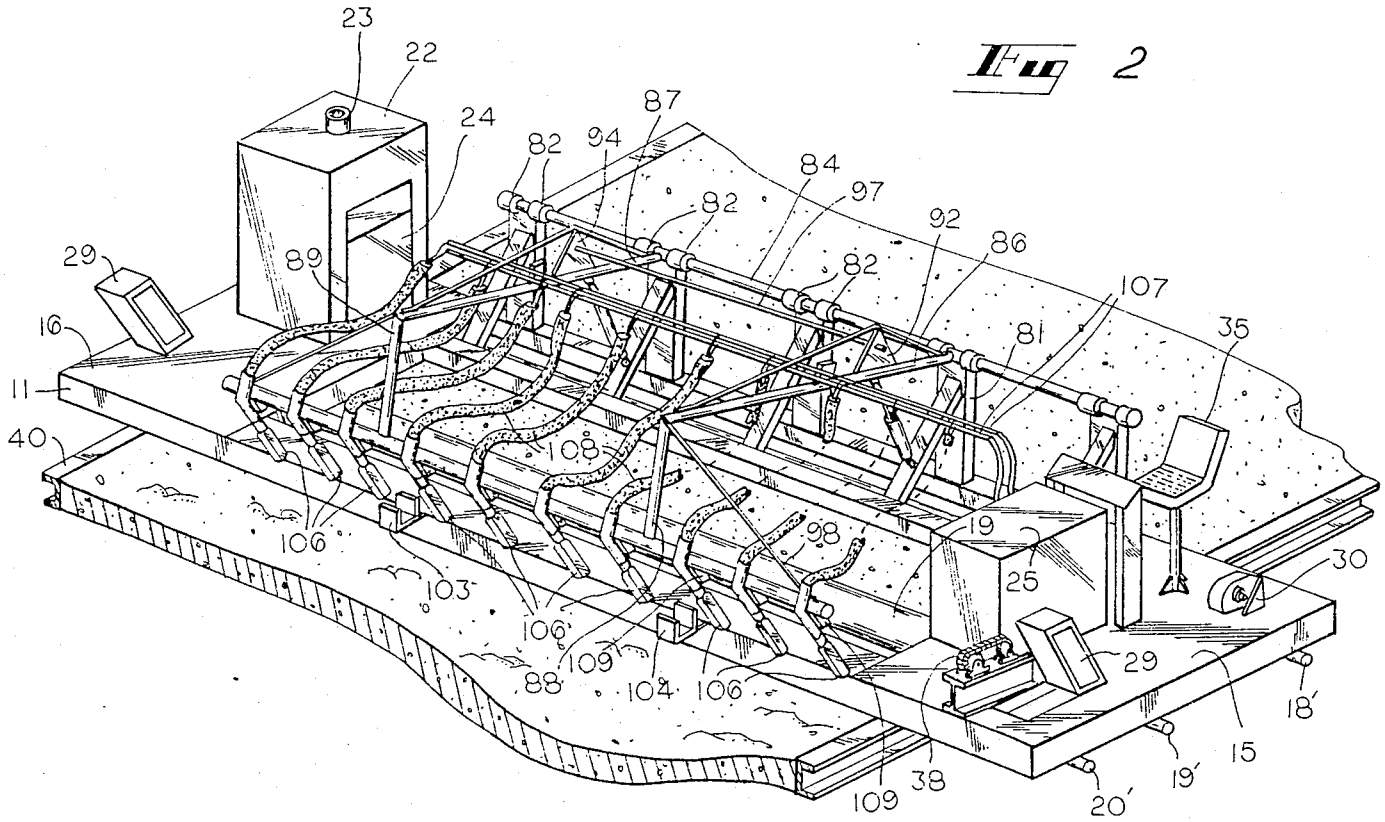
FIG. 2 is a perspective view viewed from a front quarter of the machine of FIG. 1.

The screed roller 20 is driven by the motor 31 with the power transmitted from the motor to the roller by an endless chain 38 as seen in FIG. 2. Chain 38 is routed over a sprocket mounted to the axle of the screed roller 20 so that roller is driven in a clockwise direction, as indicated by the arrows in FIGS. 3 and 4. The screed roller 20 is mounted with its axle 20' slightly higher than the axles 18' and 19', hence roller 20 rotates slightly above an imaginary reference support plane extending tangentially to the lowermost points of the drive rollers 18 and 19. The tops of the C-shaped forms 40 also lie in that reference plane.

As thus far described, the screeding machine is the same as that shown in U.S. Pat. No. 4,747,726, and, as such, it is equipped with a steering mechanism for steering the machine as it advances along the forms 40, levelling and finishing the concrete surface of a roadway being paved, between the two forms. The steering mechanism includes lift cylinders 27 and 28 which, as explained in detail in the aforementioned patent, impart steerability of the screeding machine by altering the elevation of one or the other end of drive roller 19.

The screeding machine 10 can produce a smooth, even concrete road surface, but that surface may contain irregularities and pits, and may be somewhat porous, because of the presence of air bubbles ad pockets entrapped in the material. In copending application Ser. No. 356,260, there is disclosed an attachment for the machine 10 which operates to produce a hard, polished, essentially non-porous or non-pitted surface. This attachment is depicted in FIGS. 3 and 4.

In FIGS. 3 and 4, it can be seen that the attachment comprises a finishing roller 51 of approximately the same length as rollers 18 and 19, and approximately one-half the diameter of those rollers. Roller 51 extends between a pair of support arms 52 which are pivotally mounted at either side of the machine 10, at the rear thereof. Roller 51 is raised or lowered into contact with the road surface by means of a hydraulic piston assembly 57 extending between pivotable arm 52 and an upright, fixed arm 54 mounted to the machine. It is to be understood that the mounting and raising and lowering arrangements are the same at the other end of the roller 51.

Roller 51 is rotatably driven by means of another hydraulic motor 67 mounted on arm 52, which is coupled to roller 51 by means of a sprocket 68 on the motor shaft and a sprocket 69 on the end of the axle of roller 51, which are coupled by a chain 71. The ratios of the sprocket diameters and the motor speed are such that roller 51 rotates at approximately one and one-third to two times the speed of screed roller 20, but in the opposite rotary direction thereto. Roller 51 is approximately one-half the diameter of drive rollers 18 and 19, and its speed of rotation can be varied relative to the other rollers by a change in the ratio of the diameters of sprockets 68 and 69, or by variations in the speed of motor 67.

In operation, the finishing roller 51 revolves at such a speed that there is a slight slippage of the roller on the surface, which speeds up the rise of the soupy material in the concrete to the top, and which spreads and, in effect, polishes the material. The net result is a surface which, when dry, has a smooth finish with a minimum of pits and pores.

When the concrete is poured, air in the form of bubbles and pockets is trapped in the mass to a considerable depth. These pockets and bubbles not only effect the surface of the roadway, but also they reduce the density of the material, thereby weakening it to some extent. In applications such as airport runways and heavily travelled highways, any decrease in density and corresponding decrease in strength can effect the load bearing capacity and the resistance to deterioration of the paving material, and, in extreme cases, can be quite dangerous to vehicles using the surface.

In FIGS. 1 and 2 there is shown a preferred embodiment of the present invention which reduces or eliminated entrapped air in the paving material and thereby functions to increase the density and strength thereof, and to improve surface qualities. Fixedly mounted on rear beams 13 are a plurality of upstanding posts 81 the top ends of which terminate in journals 82. For strength, posts 81 are braced by angled members 83, which extend downward from posts 81 to beam 14, to which their ends are affixed.

Supported in journals 82, and free to turn on swivels therein, is a transversely extending rod 84. Attached to rod 84 and extending toward the front of machine 10 are first and second support arms 86 and 87, the forward or distal ends of which have attached thereto and depending therefrom hanger members 88 and 89, respectively. A transversely extending beam 91 is affixed to the lower ends of hanger members 88 and 89 and is supported thereby. The structure as thus far described is stiffened and strengthened by means of a truss arrangement mounted on each of the support arms 86 and 87. The truss on arm 86 comprises a stanchion 92 affixed thereto and over which passes a guy rod 93 which is affixed at its ends to the ends of arm 86, as shown. In like manner, the truss on arm 87 comprises stanchion 94 and guy rod 96. Stanchions 92 and 94 are joined by a guy rod 97 affixed at its ends to the stanchions. The distal end of arm 86 is joined to one end of beam 91 by a guy rod 98, and the distal end of arm 87 is connected to the other end of beam 91 by a guy rod 99. The truss arrangement as described results in a strong, rigid, yet lightweight structure capable of withstanding large stresses.

Arm 86 is provided with a hydraulic piston assembly 101, connected between arm 86 and beam 14, and arm 87 is provided with a hydraulic piston assembly 102, connected between arm 87 and beam 14. Piston assemblies 101 and 102 operate in unison, under control of an operator, to raise and lower arms 86 and 87, and hence beam 91, with arms 86 and 87 pivoting about the axis of rod 84. Affixed to front or forward beam 11 are first and second U-shaped stop members 103 and 104, as best seen in FIG. 2. Stop members 103 and 104 receive beam 91 and arrest its downward travel when it is in its lowered state thereby defining the lowered position as best seen in FIG. 3.

Arrayed along the length of beam 91 and affixed thereto are a plurality of spaced hydraulic vibrators 106 which are connected to a hydraulic distribution system 107 by means of hoses 108. Hydraulic motors 109, for actuating each of vibrators 106 are mounted on beam 91. Vibrators 106, may be any of a number of commercially available types, such as, for example, WYCO Tool Co. Model 419760.

The operation of the vibrator attachment can be seen with the vibrators in their lowered or operative position in FIG. 3 and the raised or inoperative position in FIG. 4. In the operative position, the vibrators are lowered into the mass of paving material in advance or ahead of screed roller 20, to a considerable depth, extending below the aforementioned reference support plane, which is governed by stops 103 and 104, and the length the of vibrators 106. It can also be seen that the vibrators penetrate the material to a depth well below the surface of the material. As the machine 10 moves forward, vibrators agitate the glutinous mass of material, breaking up and dispensing air bubbles and pockets, and permitting the air to escape. In this manner the screed roller 20 encounters material that has been purged of most of the air therein, and hence is more compacted than would normally be the case. While the action of roller 20 might introduce small amounts of air back into the material, the effect is only on the surface, while the mass of material below the surface remains substantially air free and compacted. The following rollers, 18 and 19, and finishing roller 51 then function as previously explained to impart a smooth, level, even surface to the material, the finish of which is improved because of the absence of air bubbles and pockets in the material.

From the foregoing it is seen that the described embodiment of the invention in combination with a screeding machine produces an improved paved road or the like. It is to be understood that the foregoing description is illustrative of the principles of the invention in a preferred form thereof and that numerous modifications, additions, and deletions may be made to the structure without departure from the spirit and scope of the invention as set forth in the following claims.

We claim:

1. A screeding machine for screeding paving material comprising, in combination, a frame member having a front and a rear portion, first and second drive rollers mounted to said frame and positioned with their lower surfaces tangential to a reference support plane, a screed roller mounted on said frame in front of said drive rollers with its periphery above said reference support plane, a finishing roller mounted to a rear portion of the frame, and paving material agitating means positioned at the front portion of said frame in front of said screed roller, and means for moving said paving material agitating means between a raised position above said reference plane and a lowered position below said reference plane.

* * * * *